US005597148A

United States Patent [19]

Gospodarich

[11] Patent Number: 5,597,148

[45] Date of Patent: Jan. 28, 1997

[54] COMBINATION WHEELCHAIR AND BEVERAGE CONTAINER HOLDER FOR ATTACHMENT TO A VERTICAL SUPPORT MEMBER OF A WHEELCHAIR

[75] Inventor: James A. Gospodarich, Euclid, Ohio

[73] Assignee: Jeanette M. Kanios, Euclid, Ohio

[21] Appl. No.: 490,282

[22] Filed: Jun. 14, 1995

[51] Int. Cl.[6] ..... A47K 1/09

[52] U.S. Cl. ..... 248/311.2; 248/230.5; 297/188.2; 297/188.21; 280/304.1; 403/340

[58] Field of Search ..... 248/311.2, 230.5, 248/231.61; 297/188.01, 188.2, 188.21; 280/304.1, 727; 403/339, 340, 333

[56] References Cited

U.S. PATENT DOCUMENTS

| | | | |
|---|---|---|---|
| 2,141,849 | 12/1938 | Baer | 248/230.5 X |
| 2,932,870 | 4/1960 | Williams | 403/340 X |
| 2,946,546 | 7/1960 | Pokorny et al. | 248/230.5 X |
| 3,850,398 | 11/1974 | Kantor | 248/231.61 X |
| 4,270,724 | 6/1981 | McMullen | 248/230.5 X |
| 4,560,128 | 12/1985 | Willeby et al. | 248/311.2 X |
| 4,711,422 | 12/1987 | Ibanez | 248/230.5 X |
| 4,753,449 | 6/1988 | Doucet | 280/304.1 |
| 4,997,156 | 3/1991 | Allen | 297/188.2 X |
| 5,060,832 | 10/1991 | Link | 248/311.2 X |
| 5,257,765 | 11/1993 | Halle | 248/311.2 X |
| 5,326,064 | 7/1994 | Sapien | 248/311.2 |
| 5,356,107 | 10/1994 | Sinohuiz | 248/311.2 |
| 5,400,990 | 3/1995 | Frankel | 248/311.2 |
| 5,423,509 | 6/1995 | LaPorte et al. | 248/311.2 |

FOREIGN PATENT DOCUMENTS

| | | | |
|---|---|---|---|
| 2612064 | 9/1988 | France | 248/311.2 |
| 550075 | 4/1943 | United Kingdom | 403/340 |

*Primary Examiner*—Alvin C. Chin-Shue
*Assistant Examiner*—Brian J. Hamilla
*Attorney, Agent, or Firm*—Jane M. Marciniszyn

[57] ABSTRACT

The present invention relates to a wheel chair and a cup holder which is adapted to be secured to the vertical tubular support member of the wheelchair for supporting various sizes beverage containers. The holder comprises a base for supporting a small container, e.g., coffee cups, a flat ring mounted on the base for supporting a large container. The ring having a substantial inner surface height to support the sidewall of the small container. The base can be provided with an opening for liquid drainage. Mounted to the ring is a continuous circular wall having a substantial height for supporting the sidewall of a large container. The wall can be notched for the protrusion of coffee cup handles. Projecting outwardly the wall and integral therewith a first attachment arm having an inner surface. A second attachment arm having an inner surface is provided. The first and second attachment arms each have curved portions and a centrally disposed arcuate portion on their respective inner surface. The arcuate portions of the first and second arms when aligned define an aperture approximate the size of the diameter of the vertical tubular support member of a wheelchair. The mating of the curved inner surfaces of the support arms prevents the enlargement of the aperture after repeated repositioning of the holder from a normal position to another position. Another container holder includes a tapered wall for engaging sidewall of large beverage containers and having the same integral attachment arm and second arm.

18 Claims, 6 Drawing Sheets

COMBINATION WHEELCHAIR AND BEVERAGE CONTAINER HOLDER FOR ATTACHMENT TO A VERTICAL SUPPORT MEMBER OF A WHEELCHAIR

TECHNICAL FIELD

The present invention relates generally to a beverage container holder apparatus, and more particularly to a beverage container holder adapted for repeated attachments or numerous adjustments on a vertical tubular support member of a wheelchair and capable of supporting cups, glasses, cans, mugs and the like of different sizes.

BACKGROUND OF THE INVENTION

It is common to see an individual walking along anywhere carrying a beverage container in one hand. One less often sees an individual in a wheelchair carrying a beverage container. It is difficult for a wheelchair user to continually hold a beverage container whether the wheelchair is in a resting position or in motion. As condensation develops around a cold beverage container, it becomes even more difficult as the wheelchair user is also trying to prevent the condensed water from dripping on to him/herself. When the wheelchair user is trying to navigate the wheelchair, it is particularly difficult to hold the beverage container and impossible to hold the beverage container if the user is also holding numerous other items, e.g., a purse and a magazine. In addition, a lot of wheelchair users are confined to their wheelchair and therefore remain seated in their wheelchair during a meal. Usually the armrests of a wheelchair need to fit under a table so as to position the user as close possible to the dining table.

Beverage container holders have been disclosed for use on bicycles, theater seats, cars and hospital beds for a few years but not specifically for wheelchairs. Presently, there is available a plastic molded convenience tray that provides a recess for the placement of a beverage container. The tray, when in use, is positioned to rest on a wheelchair armrest and extend out from the wheelchair. The tray's position is maintained by two side brackets. One problem with the tray is that the molded plastic recess for the beverage container does not provide adequate sidewall support for large beverage containers nor does it provided an outlet for condensation. Although the tray can be easily removed in order for the wheelchair armrests to fit under a dining table, the tray would need to be stored as it is too bulky to be held. Considering the breath of both the tray and the wheelchair, the tray could not remain in position when the user is navigating the chair, much less could the user carry the tray with him/her when navigating the chair.

SUMMARY OF THE INVENTION

Accordingly, the present invention provides a beverage container holder suitable for supporting a variety of different size beverage containers, whether the beverage container has a consistent diameter top to bottom or a tapered diameter top to bottom (frusto-conical), e.g., a coffee mug, a large STYROFOAM® beverage container/tumbler, a can or a small STYROFOAM® beverage container, and which may be securable to a vertical tubular support member of a wheelchair. Further, the present invention allows the beverage container holder to be repositioned up, down, sideways, repeatedly. For example, the beverage container holder may need to be repositioned from a normal position to a lower or adjacent position in order for the wheelchair to more closely approach a table and then be repositioned back to the normal position at a later time. The beverage container holder must be able to accommodate different size mugs or cups with handles.

In its broader aspects the beverage container holder of the present invention is securable to a vertical tubular support member of a wheelchair. The holder compromises a circumferentially continuous wall open at both ends, wherein the upper end having a larger diameter than the lower end and the ends sized for engaging a portion of a tapered beverage container sidewall. Integral with the wall and projecting outwardly from the wall is an attachment arm. The arm has an inner surface. Along the inner surface is a centrally positioned arcuate portion and positioned on either side of the arcuate portion are curved portions. A second attachment arm is provided. The second attachment arm has an inner surface and centrally positioned thereon is an arcuate portion and positioned on either side of the arcuate portion are curved portions. An aperture having approximately the same diameter as the diameter of the vertical tubular support member of a wheelchair is define when the two arms arms mate along the curved portions. The two attachment are substantially thick for supporting the weight of a large, full beverage container. Securing means for positioning the first and second attachment arm arcuate portions on the vertical tubular support member of the wheelchair are provided whereby the curved portions of the arms mate. The holder can be repeatedly repositioned by loosening and tightening said securing means without the enlargement of the aperture.

Another embodiment of the present invention is a holder adapted for repeatedly being repositioned on a vertical tubular support member of a wheelchair, the holder comprising a generally circular flat base for supporting a small beverage container. A flat ring is mounted on the base having the substantially same outer diameter as the base. The upper and lower surfaces of the ring are substantially wide for supporting a large beverage container. The ring has a substantially high inner sidewall surface for supporting the sidewall of the small beverage container. A circumferentially continuous wall is mounted on said ring having substantial height for supporting the sidewall of a large beverage container. The wall has substantially the same diameter as the base and ring. Integral and projecting outwardly the wall is a first attachment arm. The arm has an inner surface. Along the inner surface is a centrally position an arcuate portion. On either side of the arcuate portion are positioned curved portions. A second attachment arm having an inner surface is provided. The inner surface of the second attachment arm has a centrally positioned arcuate portion and on either side of the arcuate portion are positioned curved portions. When the two attachment arms are aligned an aperture is defined and the curved portions of each arm mate. The aperture is substantially the same diameter as the vertical tubular support member of a wheelchair. A means for securing the first and second attachment arms on the vertical tubular support member is provided whereby the curved portions mate and wherein the holder can be repeatedly repositioned on the vertical tubular support member of the wheelchair by loosening and tightening the securing means without enlarging the aperture.

The various features and advantages of the invention will become more apparent from the detailed description of a preferred embodiment of the invention when considered along with the accompanying drawings.

BEST MODE FOR CARRYING OUT THE INVENTION

Figure 1:
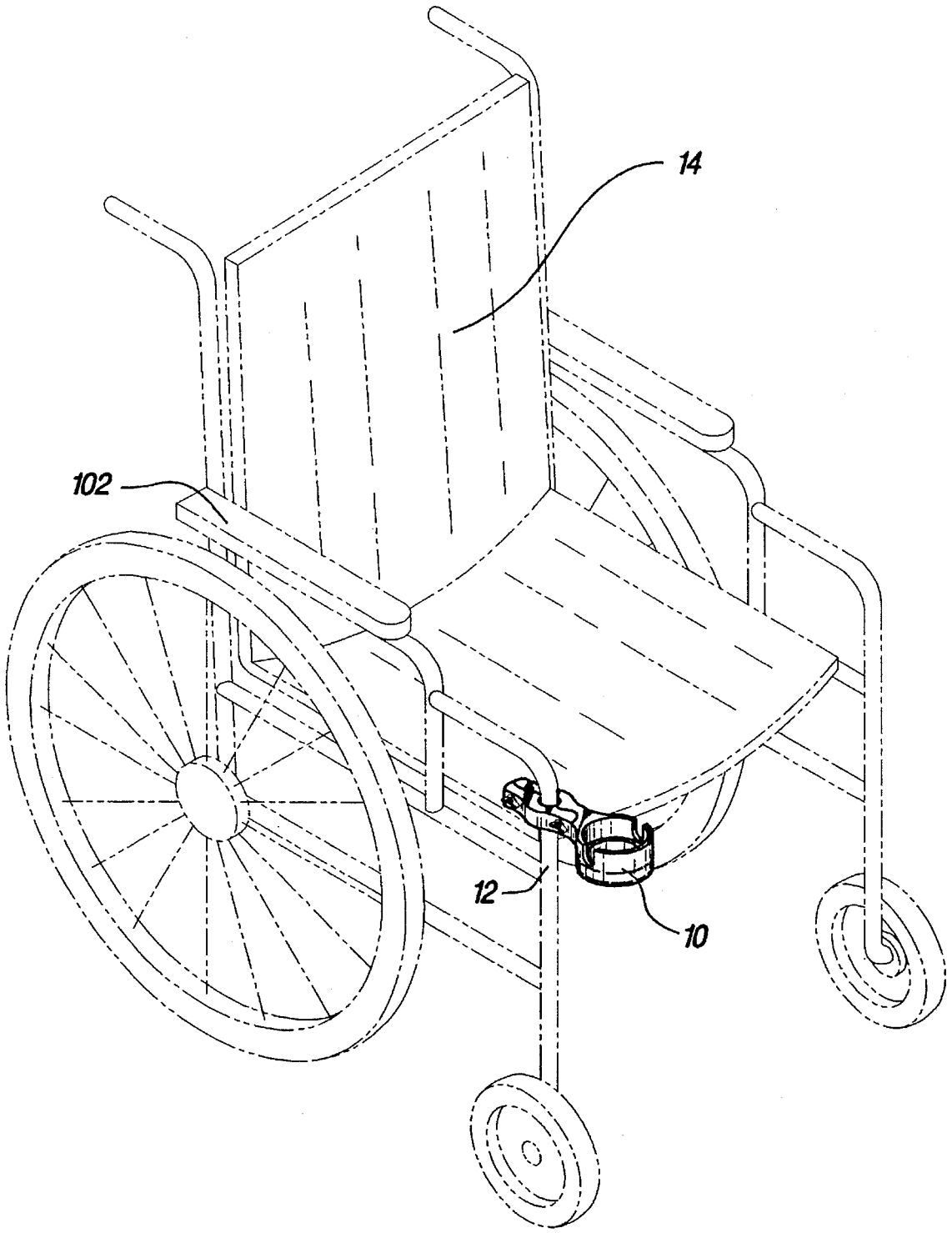
FIG. 1 is a perspective view of a preferred embodiment of the present invention shown in installed relationship to a wheelchair.
Figure 2:
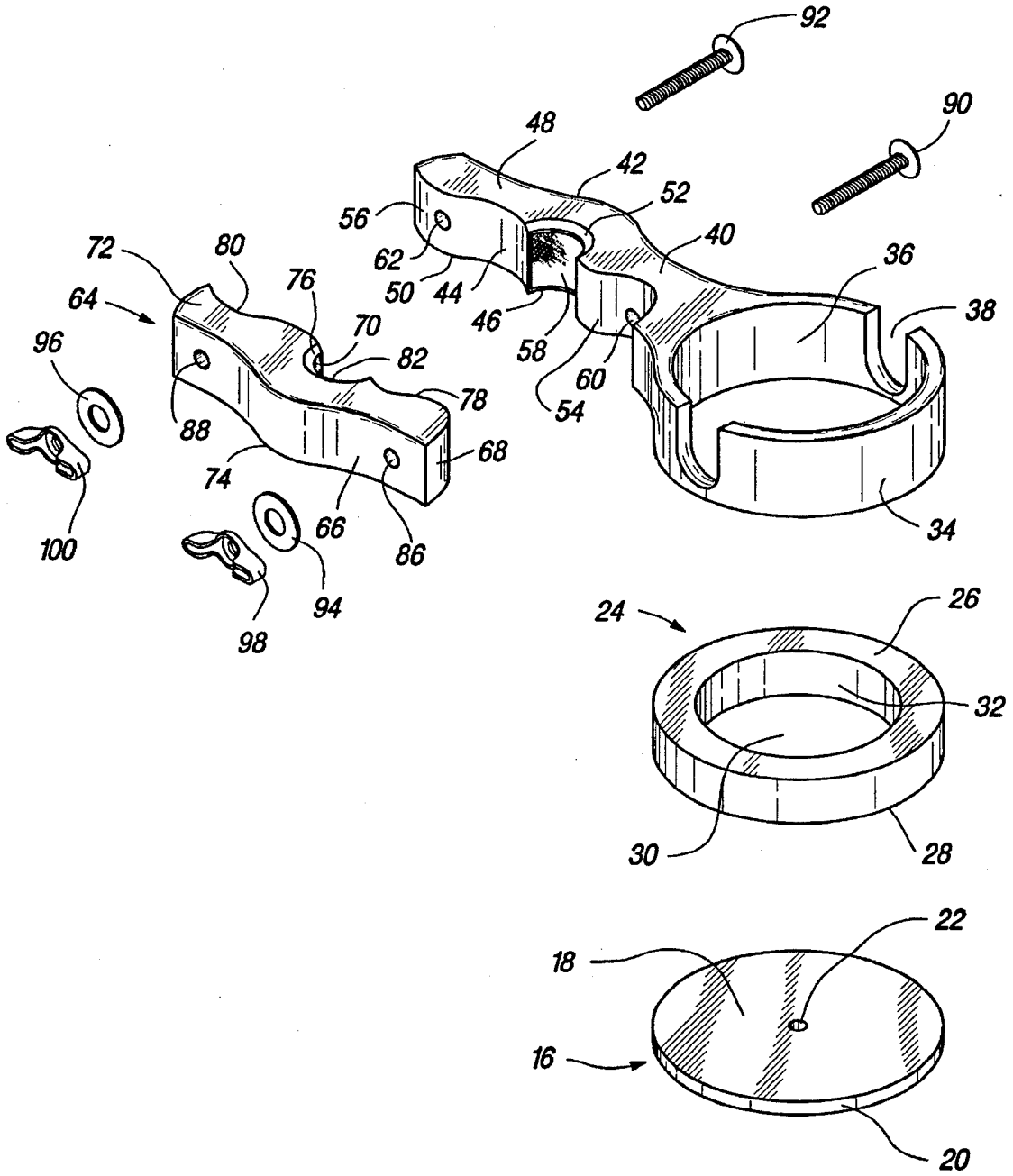
FIG. 2 is an exploded view of the preferred embodiment of the present invention.

Referring now to the drawings and in particular to FIGS. 1–4, there is illustrated therein a cup container holder assembly in accordance with the present invention being indicated generally at 10. As seen with reference to FIG. 1, cup holder assembly 10 is designed to be removably mounted to a portion of a vertical tubular support member 12 of a wheelchair 14. As shown in FIG. 2, the cup holder comprises a base 16. The base is flat and generally cylindrical. The lower outer surface of a small beverage container is supported centrally on the base flat upper surface 18. The diameter of the base is between 4 and 4½ inches and the height of the base sidewall 20 is between ⅛ and ½ inches. At least one opening 22 is vertically disposed therethrough the base. The opening 22 allows for liquid drainage out of the holder 10. The base 16 can be made of wood, plastic or any other suitable material.

The cup container holder further comprises a ring 24 which secures to the upper surface 18 of the base thereby providing a stepped-down support. The ring 24 has approximately the same outer diameter as the base 16, i.e., between 4 and 4½ inches. The ring is flat on both its upper surface 26 and lower surface 28. The lower surface 28 secures by suitable means to the upper surface 18 of the base 16, preferably by a glue. A large beverage container rest on the upper surface 26 of the ring, which is approximately ½ to 1 inch in diameter. A generally circular opening 30 is centrally disposed in the ring 24. The opening has a diameter substantially wide for receiving the lower outer surface of a small beverage container. Preferably, the opening is approximately 2 to 2½ inches in diameter. The inner sidewall surface 32 of the ring provides support for the small beverage container sidewall and prevents the movement and/or rocking of a beverage container therein. Preferably, the height of the sidewall 32 is between ½ and 1 inch. The ring 24 can be made of wood, plastic or any other suitable material.

The cup container holder further comprises a wall 34. The wall 34 is cylindrical and has a diameter substantially the same size as base 16 and ring 24, i.e., between 4 and 4½ inches. Wall 34 is mounted on the upper surface 26 of the ring by suitable means, preferably a glue. The inner sidewall surface 36 of the wall is substantially high for supporting the sidewall of a large beverage container and maintaining the beverage container within the holder 10. A suitable height of the sidewall 36 is approximately 1 to 2 inches. Notches 38 are open at their upper surface and spaced along the wall for receiving cup handles. Having a notch on either side of the holder is beneficial for both right handed and left handed users. In addition, the notches permit the user to place his/her fingers through a notch for the purpose of gripping the beverage container. A suitable notch 38 is between 1 and 1½ inches deep with a ⅜ inch radius on the bottom.

Figure 4:
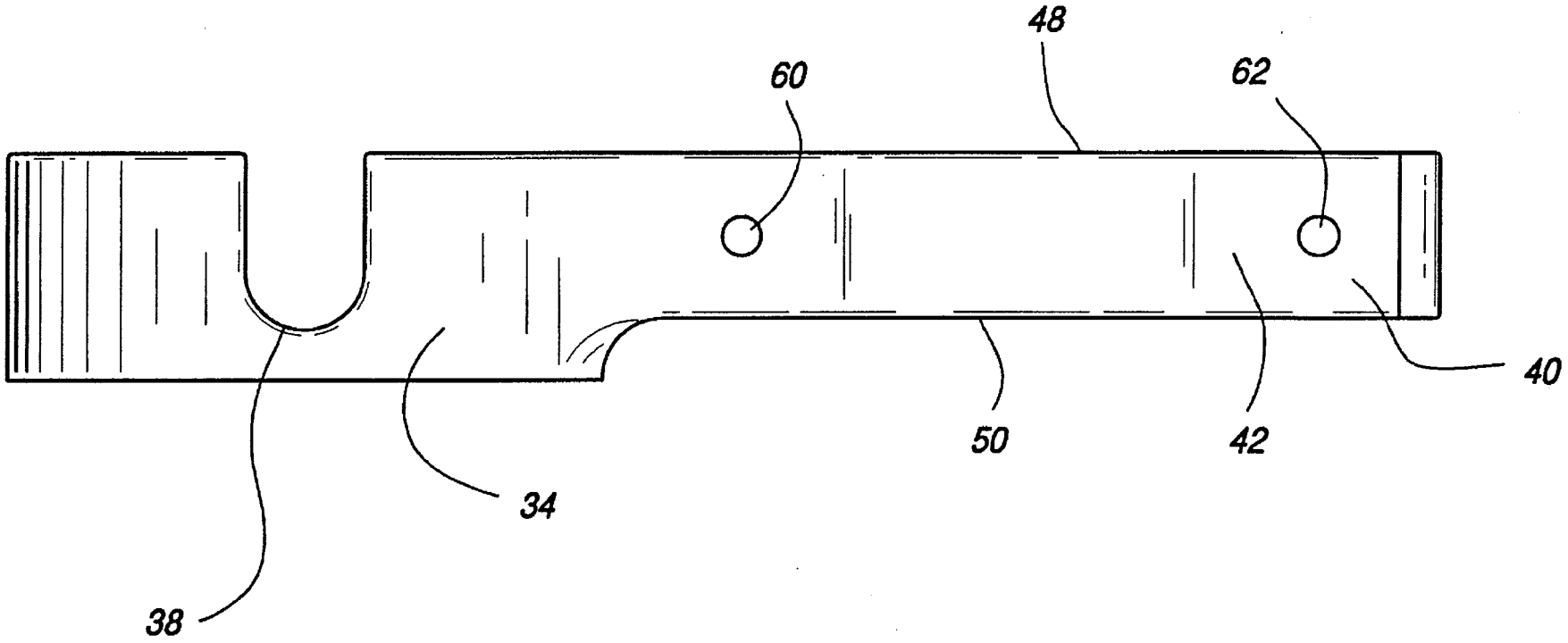
FIG. 4 is a side plan view of the wall and integral arm of the present invention.

Integral with the wall 34 is a first attachment arm 40 extending outwardly the wall. The upper margin of the wall and the first attachment arm form a smooth continuation of each other. In order to provide strength to the arm, the arm is integral with the wall and can be made from one piece of wood cut along the grain of the wood. The attachment arm 40 has an outer sidewall surface 42 and an inner sidewall surface 44. Centrally positioned along the inner sidewall surface 44 is an arcuate portion 46. The arm has an upper flat surface 48 and a lower flat surface 50. The arcuate portion can be chamfered 52 on the upper surface. On either side of the arcuate portion 46 are positioned curved portions 54 and 56. A textured material 58, e.g., felt, is secured to the surface of the arcuate portion 46. As shown in FIG. 4, the whole arm 40 need not be as deep as the wall 34, i.e., it can be between ½ to ⅜ inch less deep than the wall or between 1 to 1⅛ inch deep. The arcuate portion 46 and the curved portion 56 of the arm should be no more than 1⅛ inches thick, preferably no more than 1 inch deep. As there are a variety of wheelchairs and vertical tubular support members, having the arm depth 1⅛ inches or less and chamfered allows the holder 10 to be positioned on any one of them. The arm 40 cannot be too short or it would not be able to support the weight of a large, full beverage container, preferably the arm 40 is between 5 and 6 inches long, between ½ and 1¼ inches wide and 1 inch thick. Two holes 60 and 62 are horizontally disposed therethrough the arm 40 and centrally positioned about 1½ inches from the center of the arcuate portion 46 within each curved portions 54 and 56. The first attachment arm 40 and wall 34 can be made of wood, plastic or any other suitable material.

Figure 3:
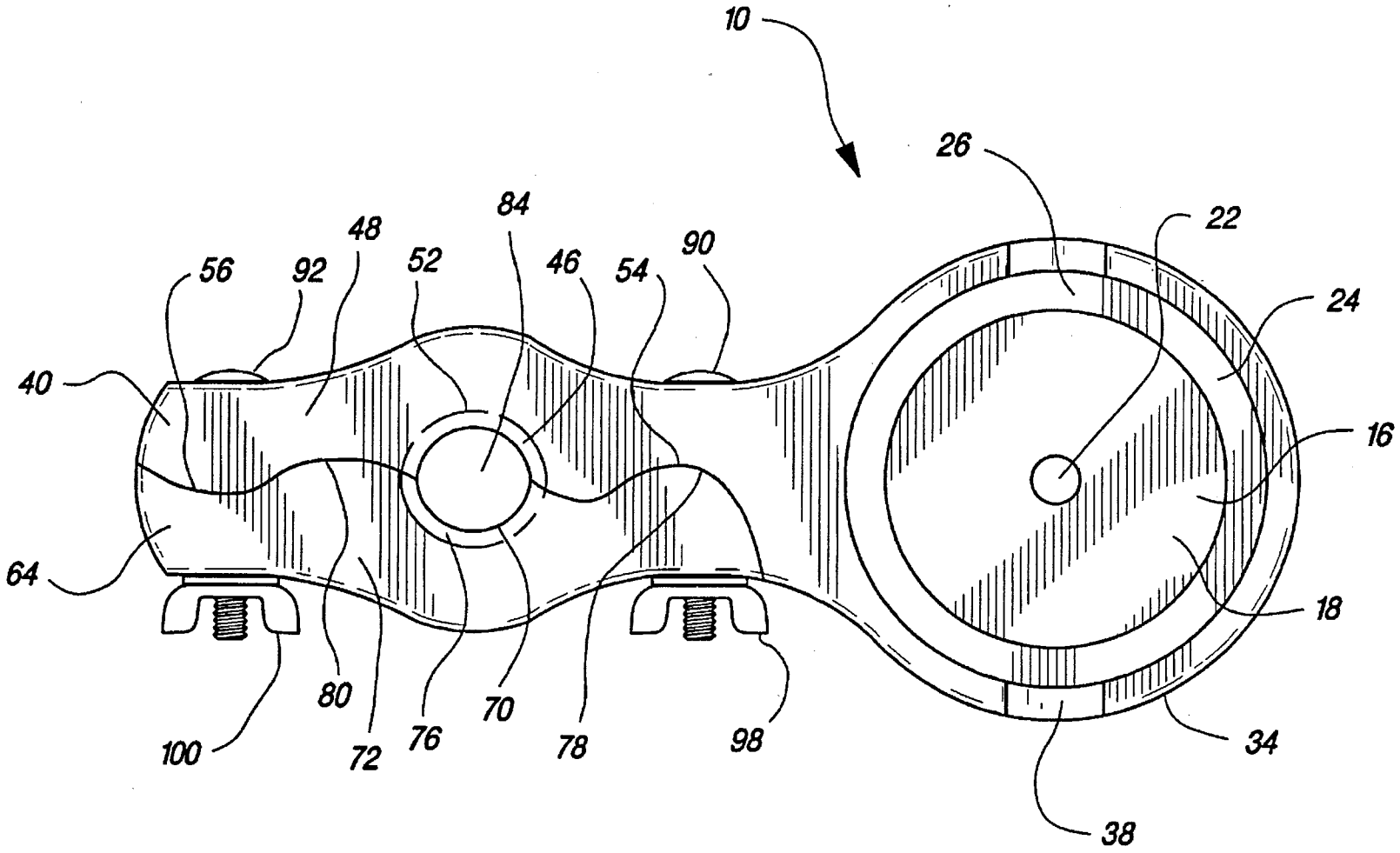
FIG. 3 is a top plan view of the present invention.

A second attachment arm 64 is shorter in length than the first attachment arm 40, i.e.,between 4 and 6 inches. The second arm 64 has an outer sidewall surface 66 and an inner sidewall surface 68. Centrally positioned along the inner sidewall surface 68 is an arcuate portion 70. The arm 64 has an upper flat surface 72 and a lower flat surface 74. The arcuate portion 70 can be chamfered 76 on the upper surface 72. On either side of the arcuate portion 70 are curved portions 78 and 80. A textured material 82, e.g., felt, is secured to the surface of the arcuate portion 70. The second attachment arm 64 is substantially the same height and width as the first attachment arm 40. The second arm 64 is not attached to the wall 34 although it can be attached with a hinge to prevent loss. The arms 40 and 64 are each of a width, approximately 1 inch, such that together the weight of a full, large beverage can be firmly supported. There are at least two different vertical tubular support members for wheelchairs. A cylindrical aperture 84 as shown in FIG. 3 is created when the arcuate portions 46 and 70 of the first and second arm 40 and 64 are positioned adjacent each other. The diameter of the aperature 84 is approximately the size of the diameter of the vertical tubular support member of a wheelchair, about ⅞ of an inch for most wheelchairs, although some vertical support members are ¾ inch in diameter. The textured material 58 and 82 provide additional traction of the holder 10 with the vertical tubular support member 12 of the wheelchair 14. The curved portions of each arm mate, i.e. 54 and 78, 56 and 80. The mating of the curved portions of each inner arm sidewall surface prevents movement and wear of the aperture during repeated adjustments of the holder 10 on the vertical tubular support member 12. It is desirable to prevent wear or enlargement of the aperture 84 so that the holder remains firmly positioned for use on the vertical tubular support member. Having one arm 40 integral with the wall 34 provides greater support for heavy beverage containers. Two holes 86 and 88 are horizontally disposed therethrough each of the curved portions 78 and 80 of the arm 64. Two screws 90 and 92, two washers 94 and 96, and two wing nuts 98 and 100 maintain the curved portions in the mated position on the vertical support member 12. Each screw has a head at one end and is screw threaded to receive a wing nut at the other end. Screws 90 and 92 extend through holes 60 and 86, and 62 and 86. One can loosen and tighten wing nuts 98 and 100 to reposition the holder from a normal position to another position. The second attachment arm can be made of wood, plastic or any other suitable material.

When the apparatus is used, the first 40 and second 64 arms are positoned so that the arcuate portions 46 and 70 engage the vertical turbular support member 12 of the wheelchair 14. The holder can be used on either the right or left side of the wheelchair. As shown in FIG. 1, for the right handed user, the integral arm 40 is place on the inside of the tubular support member 12 and the second attachment arm 64 is placed on the outside of the tubular support member 12. For the right handed user, the screws 90 and 92 are inserted into and through the holes 60 and 86 and 62 and 88. The washers 94 and 96 are placed on screws 90 and 92 followed by the wing nuts 98 and 100. The wing nuts are threaded on the screws away from the user, i.e., on the outside of the tubular support member. When the wing nuts are tightened, the curved portions 54 and 78 and 56 and 80 mate and the holder 10 is firmly secured to the vertical support member 12. By simply loosening and then tightening the wing nuts 98 and 100, the holder 10 is repositioned up or down on the vertical support member 12. Large beverage containers rest on the upper surface 26 of the ring 24 and the container sidewalls are supported by the wall 36. Small beverage containers rest on the base 16 and the container sidewalls are supported by the inner surface 32 of the ring 24. If a container has a handle, the handle is positioned in the notch 38. The holder 10 projects outwardly from the wheelchair armrest 102 so that support of the container does not interfere with use of the armrest.

Figure 5:
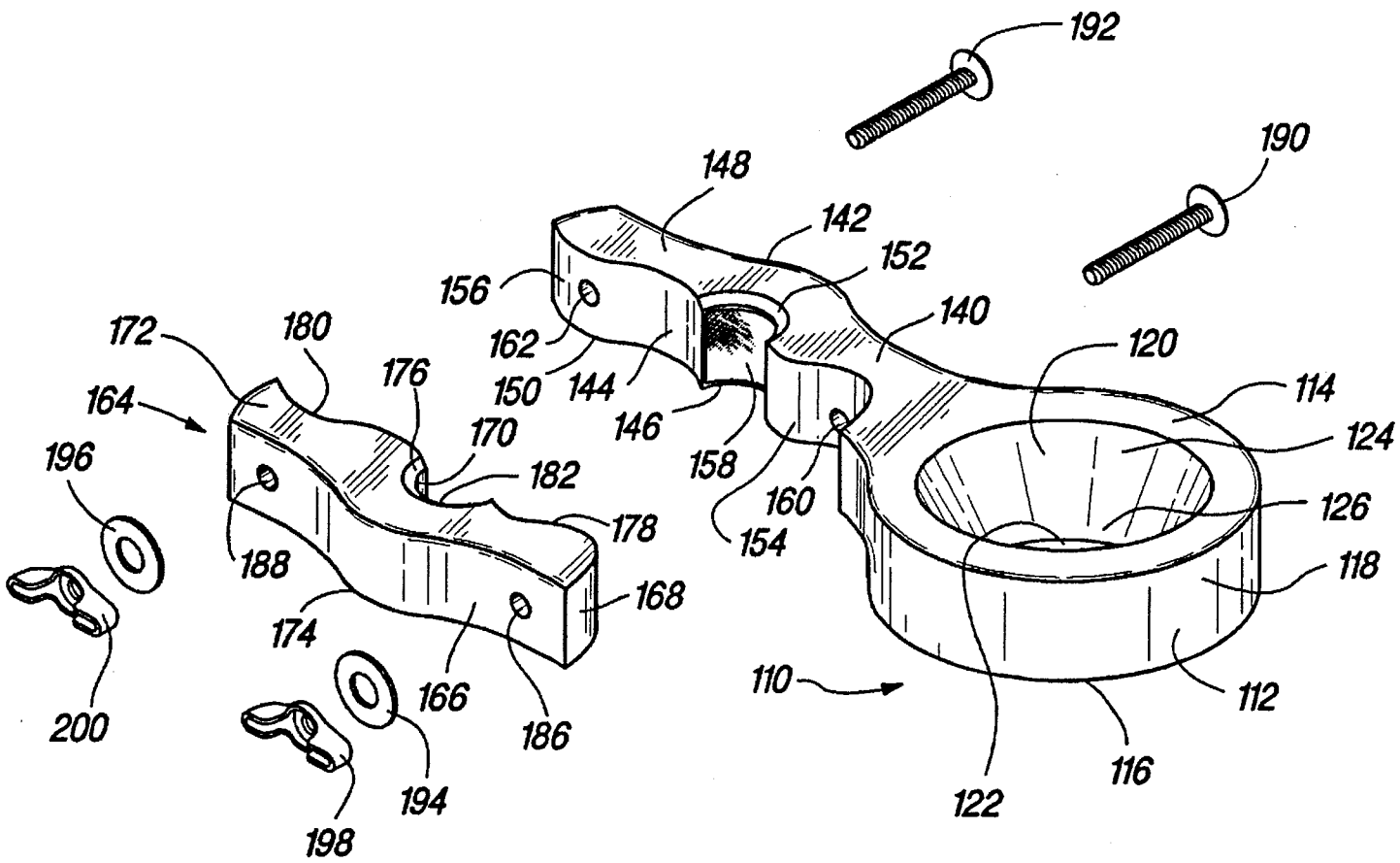
FIG. 5 is an exploded view of a second embodiment of the present invention.
Figure 6:
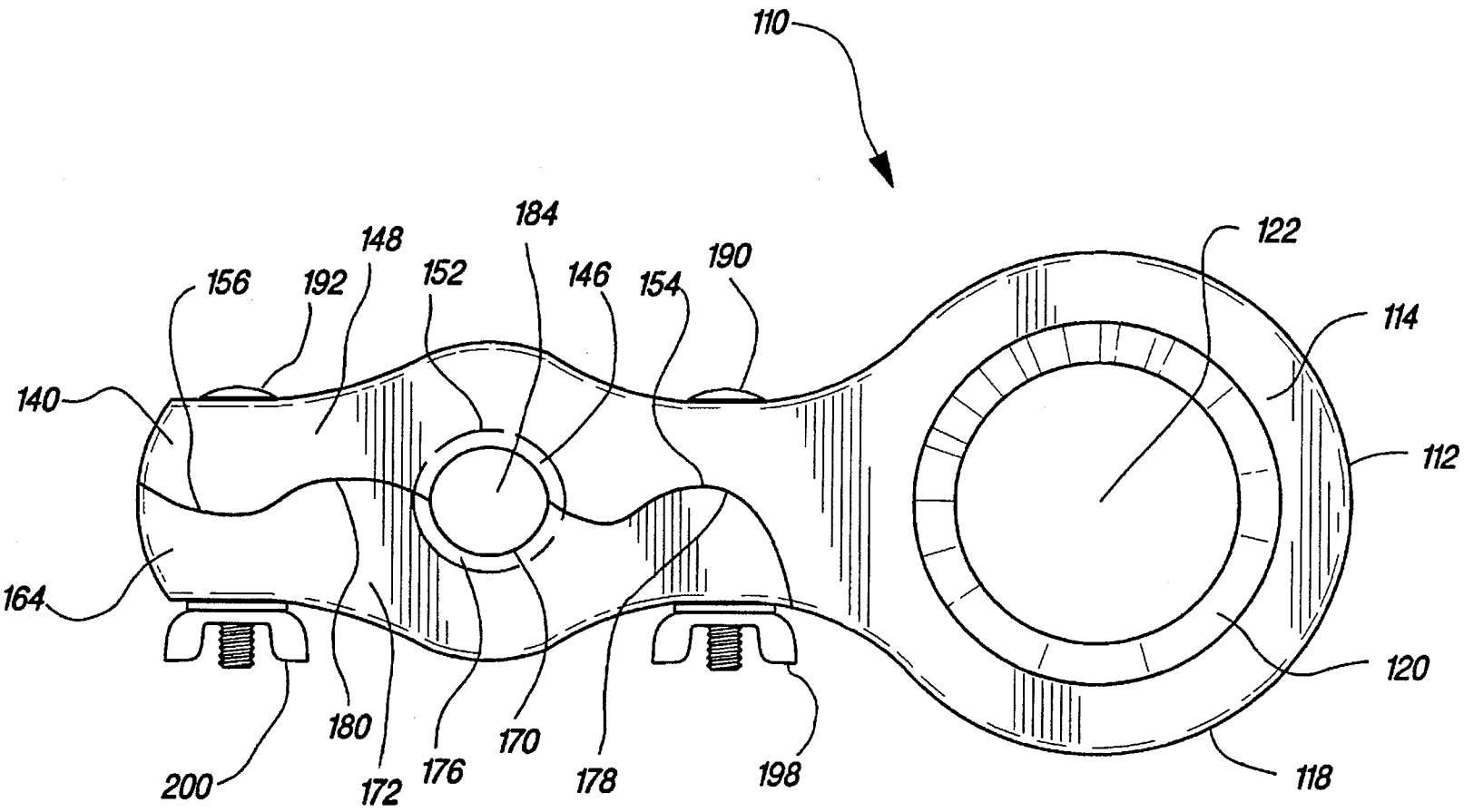
FIG. 6 is a top plan view of the second embodiment.

A second embodiment of the present invention is shown in FIGS. 5 and 6. The beverage container holder 110 comprises a continuously cylindrical wall 112 having an upper flat surface 114, a lower flat surface 116, an outer sidewall surface 118, an inner sidewall surface 120 and an opening 122. The height of the wall is between 1 inches and 3 inches. The outside diameter is between 4 and 5 inches, the inside diameter is approximately 3½ inches narrowing to 3¼ inches, i.e., the inner sidewall surface tapers slightly from upper end 124 to the lower end 126. The inner sidewall surface 120 engages and supports the sidewall surface of a beverage container, preferably a beverage container having a frusto-conical or upwardly diverging sidewall, e.g., a STYROFOAM® container purchased from a fast-food restaurant.

Integral with the wall 112 is a first attachment arm 140 extending outwardly the wall. The upper margin of the wall and the first attachment arm form a smooth continuation of each other. In order to provide strength to the arm, the arm is integral with the wall and can be made from one piece of wood cut along the grain of the wood. The attachment arm 140 has an outer sidewall surface 142 and an inner sidewall surface 144. Centrally positioned along the inner sidewall surface 144 is an arcuate portion 146. The arm has an upper flat surface 148 and a lower flat surface 150. The arcuate portion can be chamfered 152 on the upper surface. On either side of the arcuate portion 146 are positioned curved portions 154 and 156. A textured material 158, e.g., felt, is secured to the surface of the arcuate portion 146. The arm 140 is between ½ to ⅜ inch less deep than the wall or between 1 to 1⅛ inch deep. The arcuate portion 146 and the curved portion 156 of the arm should be no more than 1⅛ inches thick, preferably no more than 1 inch thick. As there are a variety of wheelchairs and vertical tubular support members, having the arm depth 1⅛ inches or less and chamfered allows the holder 110 to be positioned on any one of them. The arm 140 cannot be too short or it would not be able to support the weight of a large, full beverage container, preferably the arm 140 is between 5 and 6 inches long, between ½ and 1¼ inches wide, and 1 inch thick. Two holes 160 and 162 are horizontally disposed therethrough the arm 140 and centrally positioned about 1½ inches from the center of the arcuate portion 146 within each curved portions 154 and 156. The first attachment arm 140 and wall 112 can be made of wood, plastic or any other suitable material.

A second attachment arm 164 is shorter in length than the first attachment arm 140. The second arm 164 has an outer sidewall surface 166 and an inner sidewall surface 168. Centrally positioned along the inner sidewall surface 168 is an arcuate portion 170. The arm 164 has an upper flat surface 172 and a lower flat surface 174. The arcuate portion 170 can be chamfered 176 on the upper surface 172. On either side of the arcuate portion 170 are curved portions 178 and 180. A textured material 182, e.g., felt, is secured to the surface of the arcuate portion 170. The second attachment arm 164 is substantially the same height and width as the first attachment arm 140. The second arm 164 is not attached to the wall 112 although it can be attached with a hinge to prevent loss. The arms 140 and 164 are each of a width, approximately 1 inch, such that together the weight of a full, large beverage can be firmly supported. The arms 140 and 164 are also adaptable to fit on any type of wheelchair if their width is approximately 1 inch. There are at least two different vertical tubular support members for wheelchairs. A cylindrical aperture 184 as shown in FIG. 6 is created when the arcuate portions 146 and 170 of the first and second arm 140 and 164 are positioned adjacent each other. The diameter of the aperture 184 is approximately the size of the diameter of the vertical tubular support member of a wheelchair, about ⅞ of an inch for most wheelchairs, although some vertical support members are ¾ inch in diameter. The textured material 158 and 182 provide additional traction of the holder 110 with the vertical tubular support member 12 of the wheelchair 14. The curved portions of each arm mate, i.e. 154 and 178, 156 and 180. The mating of the curved portions of each inner arm sidewall surface prevents movement and wear of the aperture during repeated adjustments of the holder 110 on the vertical tubular support member 12. It is desirable to prevent wear or enlargement of the aperture 184 so that the holder remains firmly positioned for use on the vertical tubular support member. Having one arm 140 integral with the wall 112 provides greater support for heavy beverage containers. Two holes 186 and 188 are horizontally disposed therethrough each of the curved portions 178 and 180 of the arm 164. Two screws 190 and 192, two washers 194 and 196, and two wing nuts 198 and 200 maintain the curved portions in the mated position on the vertical support member 12. Each screw has a head at one end and is screw threaded to receive a wing nut at the other end. Screws 190 and 192 extend through holes 160 and 186, and 162 and 186. One can loosen and tighten wing nuts 198 and 200 to reposition the holder from a normal position to another position. The second attachment arm can be made of wood, plastic or any other suitable material.

When the apparatus is used, the first 140 and second 164 arms are positioned so that the arcuate portions 146 and 170 engage the vertical tubular support member 12 of the wheelchair 14. The holder can be used on either the right or left side of the wheelchair. As shown in FIG. 1, for the right handed user, the integral arm 140 is place on the inside of the tubular support member 12 and the second attachment arm 164 is placed on the outside of the tubular support member 12. The integral arm 140 is be positioned on the left outside for left handed users and on the right inside for right handed users. For the right handed user, the screws 190 and 192 are inserted into and through the holes 160 and 186, and 162 and 188. The washers 194 and 196 are placed on screws 190 and 192 followed by the wing nuts 198 and 200. The wing nuts are threaded on the screws away from the user, i.e., on the outside of the tubular support member. When the wing nuts are tightened, the curved portions 154 and 178 and 156 and 180 mate and the holder 110 is firmly secured to the vertical support member 12. By simply loosening and tightening the wing nuts 198 and 200, the holder 110 is repositioned up or down on the vertical support member 12.

EXAMPLE 1

A wall with integral arm and a second arm were cut with the grain from a 2 by 10 piece of white pine. The base is provided from ¼ inch plywood. The base is 3¾ inches in diameter and ¼ inch in height. Centrally positioned in the base is a ⅜ inch opening for drainage of any accumulated condensation. A ring having a 3¾ inch diameter is secured to the base using Titebond® II Wood Glue, Franklin International, Columbus, Ohio. The ring, cut from a piece of white pine, has a 2½ inch opening, a ⅝ inch upper surface width and a ¾ inch sidewall height. A continuous wall having a 3¾ inch in diameter and 1½ inches height is secured by Titebond® II wood glue to the upper surface of the ring. Two 1⅛ inch deep notches with ⅜ inch radius are positioned in the wall. The notches open to upper surface the wall. Integral with the wall is an attachment arm. The arm is 5½ inches long, 1 inch thick and between ⅝ and 1⅛ inches wide. Centrally positioned on the inside surface of the arm is an arcuate portion. On the upper surface of the arm, the arcuate portion is chamfered. On either side of the arcuate portion are curved portions. A piece of felt is secured to the arcuate portion. A hole is drilled through each of the curved portions to the outside sidewall.

A second attachment arm is 5 inches long, 1 inch thick and between ⅝ and 1⅛ inches wide and having a centrally positioned chamfered arcuate portion and curved portions on either side. A piece of felt is secured to the arcuate portion. The second arm is not attached to the wall or to the other integral attachment arm. A hole is drilled through each curved portion to the outside sidewall.

When the attachment arms are brought together an aperture is formed. The aperture is ⅞ inches in diameter. This diameter is about the size of the diameter of the vertical tubular support member of a wheelchair. When the holder is to be secured to the vertical tubular support member of a wheelchair, for right handed users the integral arm is on the inside and the unattached arm is on the outside. Two ¼ inch bolts fit through the holes, inside to outside. The bolts have a head at one end and are screw threaded at the other end. Two ¼ inch flat washers are placed on the protruding bolt ends and then two ¼ inch wing nuts are screwed on. It is preferable to have the wing nuts away from the user. The curved portions tightly mate.

Small beverage containers rest on the base of the holder. The sidewall of the small beverage container rest on the inner sidewall of the ring. A large beverage can container rest on the upper surface of the ring and the beverage container sidewall is supported by the sidewall of the wall. The handles of coffee cup protrude into the notches.

The holder can be repositioned by loosening the wing nuts, adjusting the holder to the new location and tightening the wing nuts.

Accordingly, the preferred embodiment of an apparatus and method of manufacturing the apparatus have been described. With the foregoing description in mind, however, it is understood that this description is made only by way of example, that the invention is not limited to the particular embodiments described herein, and that various rearrangements, modifications, and substitutions may be implemented without departing from the true spirit of the invention as hereinafter claimed.

What is claimed is:

1. In combination a wheelchair and a cup holder comprising:

a. a wheelchair having a vertical tubular support member;

b. a cup holder having a circumferentially continuous wall open at both ends, said upper end having a larger diameter than said lower end and said ends having an inner diameter sized for engaging a portion of a tapered beverage container sidewall;

c. a first attachment arm integral and a continuation of said wall and projecting outwardly from said wall and having an inner surface, said inner surface having a substantially centrally positioned arcuate portion and curved portions positioned on each side of said arcuate portion;

d. a second attachment arm having an inner surface, said inner surface having a substantially centrally positioned arcuate portion and curved portions positioned on each side of said arcuate portion, wherein when said first and second attachment arms contact each other, said inner surface curved portions mate and said arcuate portions define an aperture approximately the size of the diameter of said wheelchair vertical tubular support member for receiving said vertical support member and said first and second attachment arms being substantially thick for supporting the weight of a large, full beverage container within said wall; and e. a means for removably securing said first and second attachment arm arcuate portions on said vertical tubular support of said wheelchair whereby said curved portions of said first and second arms mate and wherein said cup holder can be repeatedly repositioned by loosening and tightening said securing means without enlargement of said aperture.

2. The combination according to claim 1, wherein said upper end diameter of said cup holder being 3½ inches and said lower end diameter being 3¼ inches.

3. The combination according to claim 1, wherein said cup holder is fabricated from wood.

4. The combination according to claim 1, wherein said cup holder is fabricated from plastic.

5. The combination according to claim 1, wherein said arcuate portions are chamfered.

6. The combination according to claim 1, wherein said wall being between 1½ inches and 1⅝ inches deep and wherein said first and second attachment arms being approximately 1 inch thick.

7. The combination according to claim 1, further including a textured material covering said arcuate portions.

8. In combination a wheelchair and a cup holder comprising:

a. a wheelchair having a vertical tubular support member;

b. a cup holder having a generally circular flat base for supporting a small beverage container;

c. a flat ring mounted on said base having an outer diameter approximate the same outer diameter of said base and upper and lower flat surfaces being substantially wide for supporting a larger beverage container, said ring having a centrally disposed opening with an inner sidewall surface of substantial height for supporting the sidewall of the small beverage container;

d. a circumferentially continuous wall mounted on said ring of substantial height for supporting the sidewall of the large beverage container and approximately the same outer diameter as said ring and said base;

e. a first attachment arm integral and a continuation of said wall and projecting outwardly from said wall, said first attachment arm having an inner surface, said inner surface having a substantially centrally positioned arcuate portion and curved portions positioned on each side of said arcuate portion;

f. a second attachment arm having an inner surface, said inner surface of said second arm having a substantially centrally positioned arcuate portion and curved portions positioned on each side of said arcuate portion, wherein when said first and second attachment arms are aligned said curved portions of said first and second arms mate and an aperture approximately the size of the diameter of said wheelchair vertical tubular support member is defined; and g. a means for removably securing said first and second attachment arm arcuate portions on said vertical tubular support member of said wheelchair whereby said curved portions of said inner arm surfaces mate and wherein said cup holder can be repeatedly repositioned by loosening and tightening said securing means without enlarging said aperture.

9. The combination according to claim 8, wherein said wall having notches for receiving cup handles.

10. The combination according the claim 8, wherein said securing means comprising at least one bolt and wing nut.

11. The combination according to claim 8, further including a textured material covering said arcuate portions.

12. The combination according to claim 8, wherein said base is provided with at least one opening for liquid drainage.

13. The combination according to claim 8, wherein said arcuate portions are chamfered.

14. The cup holder according to claim 8, wherein said cup holder is fabricated from wood.

15. The combination according to claim 8, wherein said cup holder is fabricated from plastic.

16. A method for manufacturing a cup holder securable to a tubular support member of a wheelchair comprising the steps of:

a. providing a wheelchair having a vertical tubular support member;

b. providing a cup holder having a flat generally circular base for supporting small beverage containers;

c. providing a flat ring having an outer diameter approximately the size of said base for supporting large beverage containers;

d. mounting said ring to said base, said ring mounted on said base provides a stepped-down support and said ring having a sidewall inner surface of sufficient height for supporting the sidewall of the small beverage container that engages said inner surface;

e. providing a wall having a first attachment arm integral therewith and a continuation thereof and extending outwardly from said wall, said wall being open at a top and a bottom thereof and having a diameter approximate the size of the diameter of said stepped-down support;

f. mounting said wall to said stepped-down support, said wall being of sufficient height as to support the sidewall of the large beverage container, and wherein said arm having an inner surface of sufficient depth to support the weight of the large beverage container, and said arm inner surface having a substantially centrally positioned arcuate portion and curved portions positioned on each side of said arcuate portion;

g. providing a second attachment arm having an inner surface, said second arm inner surface having a substantially centrally positioned arcuate portion and curved portions positioned on each side of said arcuate portion;

h. mating said curved portions of said first and second attachment arms thereby defining an aperture approximately the size of the diameter of said wheelchair vertical tubular support member; and I. providing a means for securing said first and second attachment arms together to secure the holder to said wheelchair vertical tubular support member.

17. The product in accordance with the method of claim 16.

18. The method according to claim 16, further including the step of providing a textured material to said arcuate portions.

* * * * *